United States Patent [19]

Hansen

[11] 4,030,698

[45] June 21, 1977

[54] RELEASABLE GRIPPER ASSEMBLY FOR A JACKING MECHANISM

[76] Inventor: John H. Hansen, One Granada Circle, Mount Sinai, N.Y. 11766

[22] Filed: Mar. 31, 1976

[21] Appl. No.: 672,628

[52] U.S. Cl. ..... 254/106

[51] Int. Cl.[2] ..... B66F 1/08

[58] Field of Search ..... 254/105–107

[56] References Cited

UNITED STATES PATENTS

| | | | |
|---|---|---|---|
| 2,970,445 | 2/1961 | Suderow | 254/106 |
| 3,604,683 | 9/1971 | Sutton | 254/106 |

*Primary Examiner*—Al Lawrence Smith

*Assistant Examiner*—Robert C. Watson

*Attorney, Agent, or Firm*—Cushman, Darby & Cushman

[57] ABSTRACT

A jack assembly for use in raising and lowering large platforms on columns, caissons and the like, having upper and lower annular portions interconnected by hydraulic motor means for relative vertical movement therebetween and a plurality of arcuate pneumatically operated gripper assemblies in both the upper and lower portions of the jack; each of the gripper assemblies being removably replaceable from its position in the jack assembly without removal of the jack assembly from the caisson which it surrounds.

15 Claims, 6 Drawing Figures

RELEASABLE GRIPPER ASSEMBLY FOR A JACKING MECHANISM

BACKGROUND OF THE INVENTION

1. Field of the Invention

This invention relates to an improved pneumatic or hydraulic gripper assembly of the type generally employed in conjunction with a jack mechanism and arranged to surround a column, caisson or the like for raising and lowering a base or platform such as an oil drilling rig to be supported by the caissons above a body of water.

2. Prior Art

A substantial number of prior art devices of the type to which the present invention relates, are available. These prior art mechanisms can be broken down into two basic types, the first of which is constructed almost entirely of metallic parts which are linked together by hydraulic cylinders to provide the desired jacking action. Such a device is disclosed in the Lucus U.S. Pat. No. 2,841,961.

The second type of device is one which uses inflatable annular ring members which, when inflated, urge either metallic or rubber like grippers into gripping relationship with the caisson. A device of this type utilizing the rubber like gripper members is disclosed in Slemmons U.S. Pat. No. 3,844,002.

The present invention relates more to the second of these two basic types in that it is concerned with the use of inflatable members used to urge the gripper pads into engagement with the caisson.

Although jacking mechanism of this second type have been and still are used advantageously in supporting and jacking platforms such as those used for establishing off shore oil drilling platforms and the like, there are certain disadvantages associated with these devices which are overcome by the present invention.

One such disadvantage is that the inflatable member which urges the gripper assemblies into contact with the caisson, are annular in shape much the same as an inner tube for a tire. Because these jacking mechanisms are placed over the caissons and surround them entirely it becomes a difficult procedure to replace one of the inflatable annular members on the gripper assemblies without removing the entire jacking mechanism from the caisson. This requires a substantial amount of labor in that normally the jacking mechanisms are welded or otherwise securely anchored to the platforms. In order to remove one of the jacking mechanisms a temporary holding device must be secured between the platform and the caisson and then the jacking mechanism unfastened and lifted up off of the caisson and lowered onto the platform where it may be disassembled and a new inflatable member or gripper pad inserted. The jacking mechanism is then reassembled and placed back on the caisson and welded or otherwise secured to the platform and the temporary securing device removed, before the jacking mechanism can again be used to operate the platform again. This has proven to be substantially troublesome and time consuming in the erection of a platform.

SUMMARY OF THE INVENTION

The present invention overcomes the above-described difficulties and disadvantages associated with the prior art devices by providing a jacking mechanism which utilizes a plurality of arcuate shaped inflatable gripper members and associated rubber like gripper pads which are releasably secured in the frame portions of the jacking mechanism so as to permit easy removal and installation of each of the members without removing the entire jacking mechanism from a caisson when it is in use. This results in a substantial reduction in time and expense in replacing damaged gripper pads or inflatable members over that required for prior art devices.

This is accomplished more specifically by the use of a jacking assembly having a frame means for encompassing a longitudinal outer surface portion of a caisson, the frame having upper and lower relatively movable portions which are interconnected by means of preferably hydraulic motors which connect the two portions of the frame together so as to cause relative movement therebetween along the longitudinal axis of the caisson; a plurality of arcuate shaped inflatable gripper means being releasably secured to the upper and lower portions of the frame and having inner gripping pads for grippingly engaging the outer surface of the caisson when the gripper is inflated, each gripper means being removably replaceable in the frame means without removing the frame means from the caisson; and means for attaching the jack assembly to the platform. Each gripper means has an arcuate rigid member with an inner surface concentric to the caisson releasably secured to the frame within one of a plurality of openings formed therein for insertion of the gripper means and which openings give the frame means an appearance of a honeycombed structure; the arcuate rigid member being recesses within the frame so as not to be in contact with the caisson. Each of the gripper means also has an inflatable arcuate member also disposed within each of the openings and having an outer surface portion abutting the inner surface of each of the rigid members. Each gripper means also has an arcuate pad member disposed in each opening which has an outer surface in engagement with an inner surface of the inflatable member and an inner surface engageable with the caisson, so that inflation of each of the inflatable members causes the pad members to engage the caisson by action of each inflatable member on each of the rigid members and each pad so that inflation of substantially all of the inflatable members causes the pad members to grippingly engage the caisson to hold the platform in the desired position.

Other novel features and advantages of the invention will become apparent from the following description and accompanying drawings in which:

DETAILED DESCRIPTION OF THE PREFERRED EMBODIMENT

Figure 1:
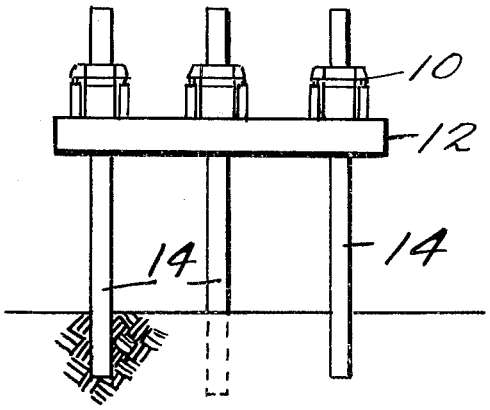
FIG. 1 is a schematic elevational view of an off shore platform of the jack up type incorporating several of the improved gripper assemblies of the present invention.

A plurality of the jack assemblies 10 constructed in accordance with the teachings of the present invention are illustrated in FIG. 1 secured to a platform 12 and in surrounding engagement with caissons 14 embedded in the ocean floor. The jack assemblies can be moved to raise or lower the platform 12 to place it in the desired position above the surface of the water.

Figure 2:
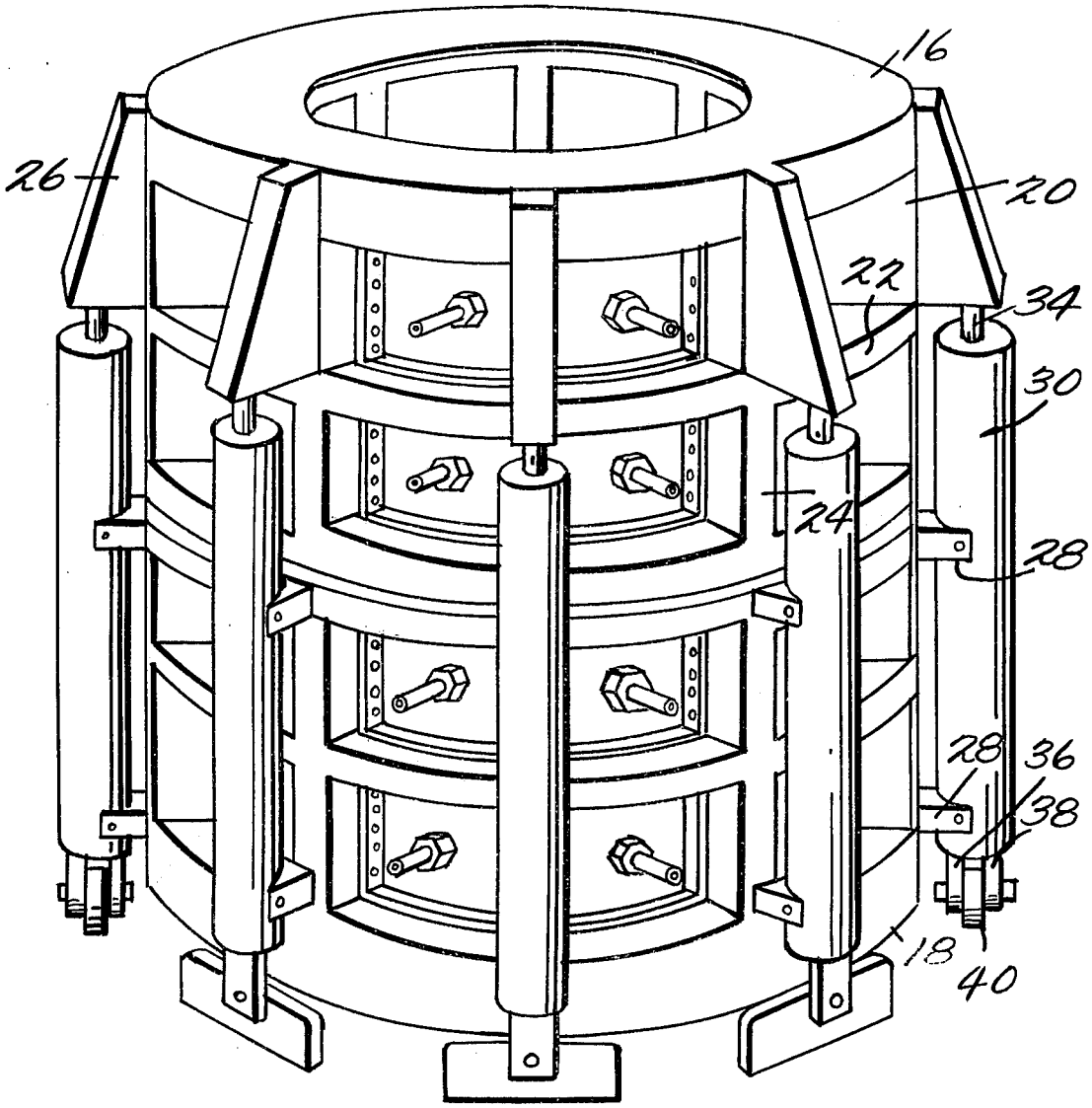
FIG. 2 is a pictorial view of an embodiment of the jack assembly of the present invention.

A single jack assembly constructed in accordance with the teachings of the present invention is illustrated in FIG. 2. The frame assembly is constructed of upper and lower portions 16 and 18, both of which are generally annular ring members having an internal diameter slightly larger than the caissons 14 onto which they are to be fitted. The frame assembly is intended to be constructed of very rigid material such as structural steel or may be prepared as a casting or other suitable fabrication technique which will result in a highly rigid frame structure capable of supporting the weight of the platform 12 in combination with a plurality of similar jack assemblies.

A plurality of openings 20 are formed in the upper and lower portions 16 and 18 of the frame assembly around the entire circumference thereof so as to form a generally honey-combed like structure with the webs 22 and 24 defining the openings and providing the necessary support for the frame assembly. The horizontal webs 22 preferably form upper and lower surfaces in the openings which are in a plane perpendicular to the longitudinal axis of the caisson. The vertical webs 24 preferably form side walls in the openings which are in radial planes containing the longitudinal axis of the caisson. This construction forms arcuate shaped openings 20 around the entire circumference of the upper and lower portions 16 and 18 of the frame assembly.

Rigidly secured to the upper portion 16 of the frame assembly, or forming an integral part thereof, are wedge shaped members 26. Secured to the lower portion 18 of the frame assembly by means of rigid brackets 28 are hydraulic motors 30. The hydraulic motors 30 are of a conventional nature and are formed of a hydraulic cylinder 32 containing a piston connected to the piston rod 34. The upper end of the piston rod is secured to the wedge shaped members 26 on the upper portion 16 of the frame assembly so that action of the hydraulic motors 30 causes the upper and lower portions 16 and 18 of the frame assembly to move relative to one another in the longitudinal direction along the caisson.

At the lower end of the hydraulic motors 30 are secured brackets 36 which are pivotally connected by pin 38 to brackets 40 which in turn are rigidly secured to the platform 12 so that movement of the lower portion 18 of the frame assembly causes a corresponding movement of the platform.

Figure 3:
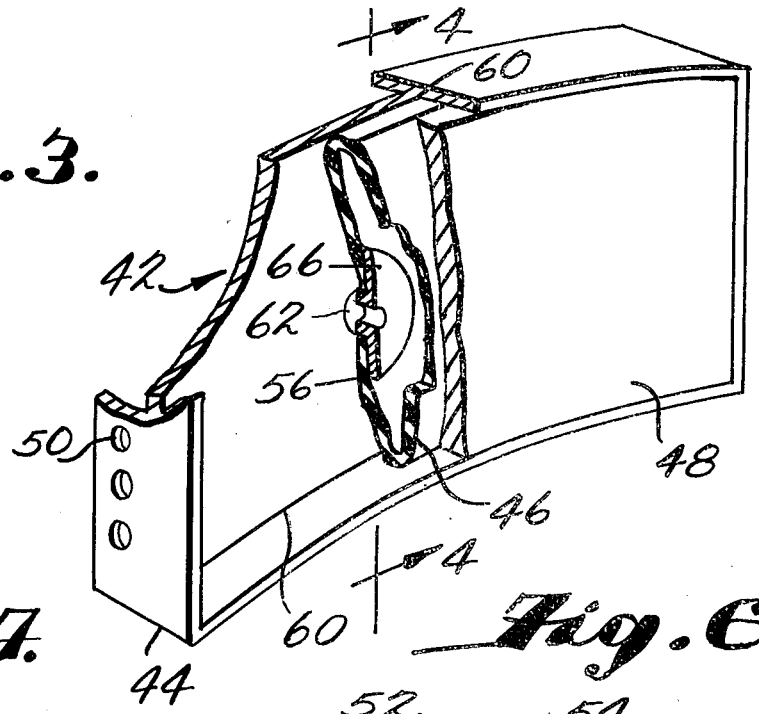
FIG. 3 is a partially cut away pictorial view of a single gripper assembly utilized in the embodiment of the jack assembly illustrated in FIG. 2.
Figure 4:
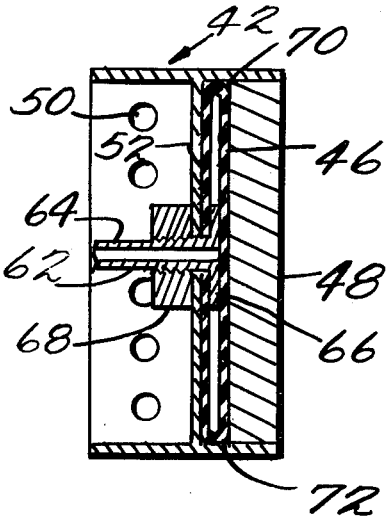
FIG. 4 is a cross sectional view of the gripper assembly of FIG. 3 taken along line 4—4.
Figure 6:
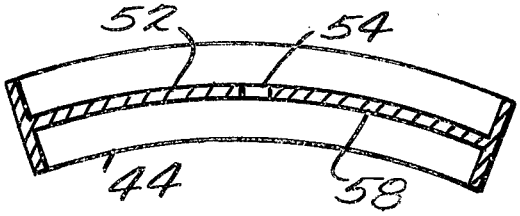
FIG. 6 is a cross sectional top view of the rigid arcuate member illustrated in FIG. 5, taken along line 6—6.
Figure 5:
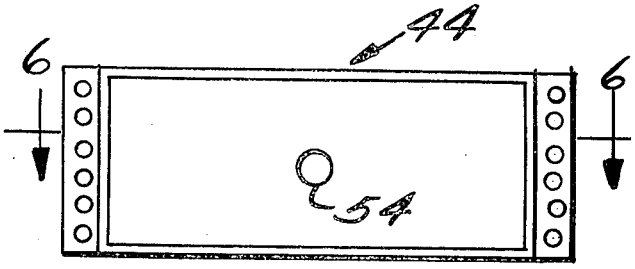
FIG. 5 is an illustration of the rigid arcuate member forming a part of the gripper assembly illustrated in FIG. 3.

Mounted within each of the openings 20 is a gripper assembly 42 best shown in FIGS. 3 and 4. Each gripper assembly 42 is generally composed of a rigid arcuate member 44, an inflatable arcuate member 46 and an arcuate gripper pad member 48. The rigid arcuate member 44 is preferably constructed of steel so as to form a very rigid structure. The cross sectional shape of the rigid arcuate member 44 is essentially an I-beam construction in both the horizontal and vertical planes with the horizontal cross sectional I-beam shape being somewhat arcuate as shown in FIG. 6; the diameter of the arc being concentric to the frame assembly which in turn is concentric to the caisson. A plurality of holes 50 are formed in the outer edge of the vertical side portions of member 44 which correspond to the holes in each of the vertical webs 24 so that the gripper assemblies 42 may be secured in the frame assembly as shown in FIG. 2. In the central portion of the web portion 52 of the member 44 is a hole 54 for protrusion of a spud described below in connection with the inflatable arcuate member 46.

The inflatable arcuate member 46 is preferably made of rubber of the like and has generally an oblong cross section in both the vertical and horizontal directions and is formed so that the outer vertical surface 56 conforms to the arcuate shape of vertical web portion 52 so as to rest against the inner surface 58 thereof. It is to be noted that the rigid arcuate member 44 may have the corners 60 rounded to conform with the curvature at the ends of inflatable member 46 as suggested in U.S. Pat. No. 3,884,002, in order to reduce stresses on the inflatable member due to sharp corners. A spud 62 is secured to the central rear wall of the inflatable member 46 for admitting and exhausting air to and from the inflatable member. Each spud 62 includes a short tubular member 64 having a radial flange 66 on its inner end overlying the marginal edge portions of an opening in the outer wall of the inflatable member 46 through which the member 64 extends. The outer end of member 64 is threaded for reception of a nut 68 to clamp the marginal edge portions of the tube opening between the flange 66 and the inner surface 58 of web 52. Lines (not shown) for supplying and exhausting air under pressure to and from each of the inflatable members 46 may be connected to the outer end of members 64 and to a source of pressurized air or liquid for hydraulically or pneumatically inflating or exhausting the inflatable members 46.

Each of the arcuate gripper pad members 48 is preferably made of tough, relatively-hard, abrasion-resistant rubber with a generally rectangular cross section in both the horizontal and vertical planes with the horizontal cross section being arcuate so as to provide an inner surface concentric with the caisson and an outer surface conforming to the inner surface of inflatable member 46. Also, the upper and lower outer edges 70 and 72 may be curved convexly so as to conform to the outer surface of the inflatable member 46 with which it will be in contact again, also to reduce the stresses produced in the inflatable member as is discussed more fully in the above referred to patent.

The entire gripper assembly 42 is preferably constructed so that the gripper pad members 48 are recessed or flush with the outer edges of rigid arcuate member 44 when the inflatable member 46 is not inflated. The gripper assembly 42 is bolted to the upper and lower portions 16 and 18 of the frame assemblies so that the inner edges of the rigid arcuate member 44 are flush with the inner surface of the webs 22 and 24 so as not to be protruding into the central opening in the frame through which the caisson moves. As mentioned above, however, each jack assembly is so designed that the internal diameter of the frame assembly is such that upon expansion of the inflatable member 46 the pad members 48 will contact and grip the caisson.

In operation, a plurality of the jack assemblies 10 are placed down over the caissons 14 by a crane and secured to the platform 12 by welding brackets 40 to the platform. Air lines from a controlled pressure source are then connected to each of the spuds 62, and the hydraulic motors 30 are connected to a controlled pressurized source of hydraulic fluid. With the jack assembly 10 resting in a position where the upper portion 16 is in contact with the lower portion 18, the platform may be moved upwards along the caisson by activating hydraulic motors 30 so that piston rods 34 are extended upwards forcing the upper portion 16 to move vertically upward along the caisson. During the upward movement of upper portion 16, air under pressure is fed to each of the inflatable members 46 in lower portion 18 so that each of the gripper pad members 48 in the lower portion 18 are urged inwardly to grippingly engage the outer surface of the caisson and hold the platform in position. Once the upper portion 16 has been extended to the desired elevation, the inflatable members 46 in the upper portion 16 are then inflated by the source of pressurized air so as to cause gripper pad members 48 to be urged inwardly towards the caisson and grippingly engage the caisson. The inflatable members in the lower portion 18 of the assembly can then be deflated so that the gripper pad members no longer grippingly engage the caisson. The platform may then be raised by reversing the hydraulic motors so that the lower portion 18 of the assembly is raised towards the upper portion 16, causing a corresponding upward movement of the platform 12. If desired, the inflatable members in the lower portion 18 may then be inflated by the pressurized source so that all of the inflatable members in both the upper and lower portions 16 and 18 will grippingly engage the caisson 14 to hold the platform 12 in the desired position.

As mentioned earlier, because of the fact that the jack assemblies 10 when used quite often in the above described manner, have a tendency to damage the pad members 48 or cause a blow out in the inflatable members 46 which necessitates the removal thereof from the assembly. In the prior art devices it was necessary to remove the entire jack assembly from the caisson since each of these members totally encircled the caisson thus prohibiting the replacing of one of these elements in any other manner. With the present invention, however, each of the gripper assemblies 42 may be independently removed by unbolting them from the webbings and then replacing the individual inflatable member 46 or arcuate gripper pad member 48 as needed, without removing the jack assemblies from the caisson. In addition, it is an advantage of the present invention that if a single gripper assembly 42 fails the remaining gripper assemblies will maintain the jack assembly 10 in its position while the individual gripper assembly is replaced. This results in a substantial savings in time and labor and is a safety feature which was not present in prior art devices.

Although the foregoing description illustrates the preferred embodiment of the present invention, it will be apparent to those skilled in the art that variations are possible. All such variations as would be obvious to those skilled in this art are intended to be included within the scope of this invention as defined by the following claims.

What is claimed is:

1. A jack assembly for releasably securing a platform or the like to a cylindrical caisson or the like, for relative linear movement of the platform in either direction axially of the caisson, comprising:

frame means for encompassing a longitudinal outer surface portion of the caisson, and having upper and lower relatively movable portions;

motor means interconnecting the upper and lower portions of the frame means for causing relative movement therebetween along the longitudinal axis of the caisson;

means for fastening the upper or lower portion of the frame means to the platform;

a plurality of arcuate-shaped inflatable gripper means releasably secured to the upper and lower portions of the frame means and having inner pad means for grippingly engaging the outer surface of the caisson when the gripper means is inflated, each gripper means being removably replaceable in the frame means without removing the frame means from the caisson.

2. An assembly as defined in claim 1, wherein the upper and lower portions of the frame means have a plurality of openings defined therein which extend through the frame means radially from the caisson and the gripper means are disposed in each of the openings.

3. An assembly as defined in claim 2 wherein the motor means comprises:

a plurality of double acting hydraulic motors equally spaced about the circumference of the frame means with a hydraulic cylinder of each secured to one of the portions of the frame means and a piston rod of each secured to the other of the portions so that only relative axial movement is permitted between the portions of the frame means.

4. An assembly as defined by claim 2 wherein the fastening means comprises:

a plurality of plates secured to the platform;

a plurality of rigid support members each rigidly secured to a respective motor means at the lower portion thereof, and each pivotally connected to a respective plate.

5. An assembly as defined in claim 2 wherein each gripper means has an arcuate rigid member with an inner surface concentric to the caisson releasably secured to the frame means within one of the openings defined therein and recessed within the frame so as not to be in contact with the caisson, each gripper means also having an inflatable arcuate member disposed within each opening with an outer surface portion abutting the inner surface of each rigid member, and each gripper means also having the inner pad means of arcuate-shape disposed in each opening with an outer surface in engagement with an inner surface of the inflatable member and an inner surface engagable with the caisson.

6. A jack assembly for releasably securing a platform or the like to a cylindrical caisson or the like, for relative linear movement of the platform in either direction axially of the caisson, comprising:

frame means for concentrically encompassing a longitudinal portion of the outer surface of the caisson in spaced relation thereto and having two interconnected and relatively axially movable portions, both portions having a plurality of arcuate honeycomb like web portions formed therein having the axes of their openings which extend parallel to their walls radially intersect the longitudinal axis of the caisson;

motor means interconnecting the two movable portions of the frame means for causing relative movement therebetween along the longitudinal axis of the caisson;

means for fastening one of the portions of the frame means to the platform so that movement of that portion longitudinally along the caisson results in a corresponding movement of the platform;

a plurality of gripper means each having an arcuate rigid member with an inner surface concentric to the caisson releasably secured to the frame means within one of the openings formed by the honeycomb like web portions and recessed within the frame means so as not to be in contact with the caisson, each gripper means also having an inflatable arcuate member disposed within each opening formed by the honey-comb like web portions with an outer surface portion abutting the inner surface of each rigid member, and each gripper means also having an arcuate pad member disposed in each opening formed by the honeycomb-like web portions with an outer surface in engagement with an inner surface of the inflatable member and an inner surface engageable with the caisson, whereby inflation of each inflatable member causes each pad member to engage the caisson by action of each inflatable member on each rigid member and each pad so that inflation of substantially all of the inflatable members causes the pad members to grippingly engage the caisson so as to hold the platform in the desired position.

7. An assembly as defined by claim 6, wherein the frame means is constructed substantially of the honeycomb-like web members.

8. An assembly as defined by claim 7, wherein the honeycomb-like web members form openings of substantially rectangular cross-section with one pair of opposed walls forming each opening disposed perpendicular to the longitudinal axis of the caisson and the other pair of opposed walls disposed in radial planes containing the longitudinal axis of the caisson.

9. An assembly as defined in claim 6, wherein the motor means comprises:

a plurality of double acting hydraulic motors equally spaced about the circumference of the frame means with a hydraulic cylinder of each secured to one of the portions of the frame means and a piston rod of each secured to the other of the portions so that only relative axial movement is permitted between the portions of the frame means.

10. An assembly as defined by claim 6, wherein the fastening means comprises:

a plurality of plates secured to the platform;

a plurality of rigid support members each rigidly secured to a respective motor means at the lower portion thereof, and each pivotally connected to a respective plate.

11. An assembly as defined by claim 6, wherein each gripper means further comprises:

the arcuate rigid member having a curved I-beam shaped cross section in both the vertical and horizontal planes;

the inflatable arcuate member having an elongated oblong cross section in both the vertical and horizontal planes, and a spud connected to the outer surface portion of the inflatable arcuate member; and the pad member having the outer surface conforming substantially to the inner surface of the inflatable arcuate member and the inner surface of the pad member being substantially flat in the vertical plane and conforming to the outer surface of the caisson in the horizontal plane.

12. A gripping assembly for releasably securing a platform or the like to a supporting leg, said assembly comprising an annular frame having a central aperture for receiving the supporting leg; a plurality of inflatable grippers arranged in a circumferential pattern around said central aperture, said grippers having inner surfaces facing radially inwardly with respect to said central aperture and being carried within said frame in a position in which, upon inflation, said grippers will expand in an inwardly radial direction so as to engage their inner surfaces with the periphery of a supporting leg in said central aperture; and support means releasably attaching each arcuate inflatable gripper to said frame for removal therefrom independently of the removal of another gripper.

13. A gripping assembly as in claim 12 wherein said support means resides in a radially facing opening in said frame, said support means being rigidly fixed to said frame.

14. A gripping assembly as in claim 13 wherein said support means includes a rigid member having an inner surface engaged by the outer surface of said inflatable gripper and fastening means connected at least a portion of the periphery of said rigid member to said frame.

15. A gripping assembly as in claim 12 wherein said support means includes a rigid web having an inner surface engaged by the outer surface of said inflatable gripper and a peripheral flange circumscribing said web, said support means residing in a radially facing opening in said frame; and fastening means connecting said flange to at least a portion of the periphery of said opening.

* * * * *